United States Patent [19]

Keller

[11] 4,030,893

[45] June 21, 1977

[54] METHOD OF PREPARING LOW-SULFUR, LOW-ASH FUEL

[75] Inventor: Leonard J. Keller, Dallas, Tex.

[73] Assignee: The Keller Corporation, Dallas, Tex.

[22] Filed: May 20, 1976

[21] Appl. No.: 688,467

[52] U.S. Cl. ..... 44/1 B; 44/1 R; 208/8

[51] Int. Cl.[2] ..... C10L 5/00; C10L 9/00; C10G 1/00

[58] Field of Search ..... 44/1 R, 1 B, 51; 208/8; 48/197 R

[56] References Cited

UNITED STATES PATENTS

| | | | |
|---|---|---|---|
| 2,133,280 | 10/1938 | Burk | 208/8 |
| 3,748,254 | 7/1973 | Gorin | 208/8 |
| 3,754,876 | 8/1973 | Pennington et al. | 44/1 B |
| 3,856,658 | 12/1974 | Wolk et al. | 208/8 X |
| 3,920,418 | 11/1975 | Rice | 208/8 X |

*Primary Examiner*—Carl F. Dees
*Attorney, Agent, or Firm*—James C. Fails

[57] ABSTRACT

A method of preparing low-sulfur, low-ash fuel from coal while simultaneously recovering valuable chemical products and taking advantage of a surprising coaction between comminution and dissolution and characterized as the steps of comminuting the coal in the presence of an alcohol containing 1–4 carbons atoms, inclusive; forming an admixture of the comminuted coal and alcohol to have a desired minimum of solids; separating the admixture into a first underflow of high density solids, a first middling stream of coal in alcohol and a first overflow stream of the alcohol and its dissolved and suspended constituents; separating the first underflow into a second underflow having therein the sulfur and solids that would form ash if burned and a second overflow comprising a dilute slurry of the coal in the alcohol and dissolved and suspended constituents; separating the first middling stream into a third underflow of high density solids, a second middling stream of coal with only a minor amount of sulfur and high density solids and a third overflow comprising the alcohol and dissolved and suspended constituents; separating the first overflow into a fourth underflow and a fourth overflow; refining the fourth overflow into respective desired chemical products, or constituents and the alcohol; and forming a low-sulfur, low-ash fuel from the second middling stream. Also disclosed are specific preferred steps including the treatment of the low-sulfur, low-ash coal to turn it into a puffed coal that burns readily to produce a hot flame with very low pollution emissions, while recovering alcohol and valuable chemicals, organic gases and the like.

17 Claims, 2 Drawing Figures

METHOD OF PREPARING LOW-SULFUR, LOW-ASH FUEL

BACKGROUND OF THE INVENTION

1. Field of the Invention

This invention relates to a method of achieving an improved fuel composition and simultaneously recovering valuable chemical products. More particularly, this invention relates to a method of effecting a low-sulfur, low-ash coal that burns readily with high efficiency and low pollution emissions; and, simultaneously recovering, by dissolution from the coal, valuable chemical products.

2. Description of Prior Art

In my earlier filed and co-pending application Ser No. 615,697, entitled "Fuel Composition and Method of Manufacture," filed Sept. 22, 1975, there was delineated the need for obtaining economical power, yet balancing the ecological considerations so as to achieve an overall improvement of our environment, reduce pollution and the like. The latter is made more difficult by the so called "energy shortage;" evidenced by curtailment of deliveries and then only at higher prices, of natural gas, gasoline and other petroleum products.

An excellent discussion of these conventional sources of power and their shortcomings is contained in an article, "Hydrogen; Its Future in the Nation's Energy Economy," W. E. Winsche, K. C. Hoffman, and F. J. Salzano, SCIENCE, June 29, 1973, Vol. 180, No. 4093. Therein, the authors delineate the projected need for large scale economical sources of energy, such as that derived from nuclear fission, solar or geothermal sources. In that article, the authors point out the disadvantages of several conventional sources of power and extoll the virtues of hydrogen as a potential future fuel, since it is non-polluting.

It is becoming increasingly apparent that certain oil-rich areas of the earth may be able to exert a disproportionately large economical and political influence if the substitute is not found for the petroliferous fuels. One widely available substitute for the petroliferous fuels is coal. Frequently, however, the coal contains sulfur, ash-producing minerals and other pollutants that make it objectionable, or make prohibitive (or at least economically infeasible) the cost of treating the coal to remove the pollutants when employed in populous areas. Moreover, the costs of mining and transporting coal over long distances have made it noncompetitive with crude oil heretofore, since crude oil was available at a cost of about $3.00 a barrel. As crude oil increases in cost to $5.00 a barrel or higher, coal becomes increasingly competitive as a source of fuel. It could be particularly competitive if a way could be found to transport the coal economically. For example, coal provides energy at the cost of about twenty cents per million British Thermal Units (BTU's). Large reserves of coal are available in the United States, notably, in Alaska, Wyoming, Utah, the central States and the lignite deposits in Texas. As indicated, transportation of coal has required a disproportionately large amount of trouble and expense.

In the hereinbefore referenced application Ser. No. 615,697, there is described a portion of the proposals that have been tried heretofore to solve the transportation problem and there is disclosed the improved process that obviates the disadvantages of the prior art. That application did not, however, reduce the sulfur by-product producing or ash producing content of the coal or recover valuable chemicals as side products.

Thus, it can be seen that the prior art has not been totally satisfactory in providing a low-sulfur, low-ash fuel from coal, and simultaneously recovering valuable chemical products.

SUMMARY OF THE INVENTION

Accordingly, it is an object of this invention to provide a method of forming a low-sulfur, low-ash fuel from coal and simultaneously recovering valuable chemicals as end products while obviating the disadvantages of the prior art.

It is a specific object of this invention to provide a coal product that has very little sulfur compounds and ash-forming solids so as to burn substantially completely with almost no pollution and simultaneously recover valuable constituents from the coal.

These and other objects will become apparent from the descriptive matter hereinafter, particularly when taken in conjunction with the appended drawings.

DESCRIPTION OF PREFERRED EMBODIMENTS

Figure 1:
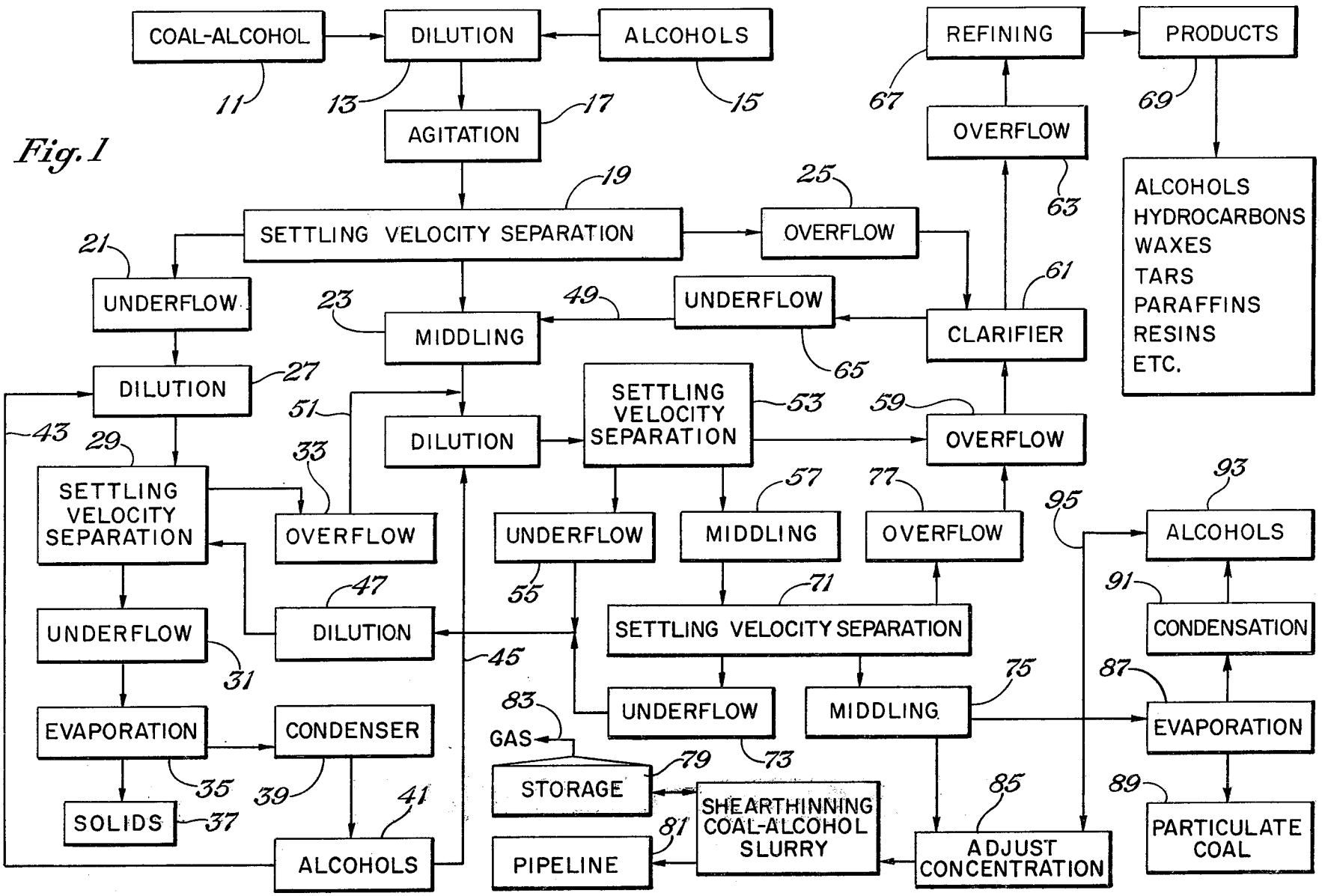
FIG. 1 is a flow diagram of one embodiment of this invention.

The coal that is employed in this invention may be any of the commercially available coals, ranging from the relatively pure and high carbon content anthracite coal through the bituminous coals to and including the less desirable soft coals, lignites and the like.

The mining and preparation of coal is described at some length in Kirk-Othmer ENCYCLOPEDIA OF CHEMICAL TECHNOLOGY, Second Edition, Anthony Standin, Editor, Inter-Science Publishers, New York, 1969, Vol. 5, pp. 606–676; and that descriptive matter is incorporated herein by reference. The coal is mined from a coal mine by either strip or underground methods, as appropriate to the respective deposit. These methods are conventional and are described on page 660 of the aforementioned Kirk-Othmer ENCYCLOPEDIA.

The preparation of coal is desired at page 661 in the above referenced Kirk-Othmer ENCYCLOPEDIA. One advantage of this invention is that it can employ the fines of the coal that were formerly discarded because of customer objections to fine coal and the loss of coal dust in loading and unloading. The exact nature of the coals in coal deposits in various states have not been completely characterized even though the deposits are known to be extensive. If a coal has a large amount of fusinite, it will be extremely friable, and will tend to concentrate in the fine size ranges during its preparation. This is helpful in practicing this invention, since the fines can be employed directly in making the coal-alcohol admixture, or slurry, that is employed at the beginning of the process. This reduces the amount of additional work required in pulverizing, or comminuting, the coal for forming the slurry, or admixture, with the methyl fuel, or alcohols. Similarly, any appreciable amounts of vitrinite will readily break into fine sizes of less than one millimeter to reduce the work of additional size reduction and comminution required to get the desired particle sizes. As is known, in making the fine particles, the amount of work is indicated by a Hargrove Index. Specifically, a low Hargrove Index indicates that more energy will be necessary in the pulverizing mill to create the coal powder. It is understood that many of the coals, such as the Alaskan coal, have a relatively high Hargrove Index; and, hence, require relatively low power to pulverize.

The coal particles are prepared to have suitable sizes. Specifically, they are all of a minus 8 mesh Tyler Standard screen size as with the majority of the particles being of −100 mesh size. If desired, the majority of the particles may be of −200 mesh size. In any event, the coal particles have a settling velocity of less than 2½ centimeters per second in water. The coal particles are worked in the presence of the methyl fuel, including the methanol, so as to dissolve the water and other alcohol soluble impurities from the coal and activate and wet the surfaces of the coal particles. This step is apparently necessary to form the sheer thinning slurry that is advantageous, described and claimed in my co-pending application Ser. No. 615,697, referenced hereinbefore, although the reason is not completely understood.

The cleaning of the coal may be less a problem, also, in this invention, since this process can use fines to obtain the benefical thixotropic properties associated with Brownian movement of the fines in the final suspensoid, when a sheer thinning suspensoid is employed in the initial phase. Where the coal is to be cleaned, any of the conventional methods may be employed. Such methods are described on page 662 of the above referenced Kirk-Othmer ENCYCLOPEDIA. The coal may be dry cleaned to eliminate drying, but there frequently results a dusty condition from air being blown through the oscillating perforated tables in the dry cleaning operation. Preferably, froth flotation is employed in the cleaning operation so as to preserve the fines. If desired, the clean coal may be dewatered. Ordinarily, for fuel, it is unnecessary, since the coal has an optimum moisture content in the range of about 6–8% for optimum combustion.

One of the surprising things, it is theorized, is that the alcohols that are employed herein will dissolve, or take up, the water and other alcohol soluble impurities and freqently enable direct reduction in size of the low grade coals, as well as effecting peptization, or colloidal dispersion of substances in the coal. Such substances, or constituents, include oils, fats, acids, alcohols, esters, resins, hydrocarbons, and waxes, as well as a varity of more complex organic chemicals; and some organic gases including methane. These chemical constituents will be discussed in greater detail hereinafter.

Expressed otherwise, the alcohol dissolution of the impurities and water will automatically effect some fracturing in the low grade coals, since the water appears to be to be necessary agglomerating the fine particles into the larger size lumps of coal.

Herein the term "alcohols" is employed to signify the alcohols including one to four carbon atoms inclusive, including methanol, ranging in purity from the substantially pure state to the crude alcohol that is produced by the gasification of coal followed by a "methanol," or alcohol, synthesis operation. These alcohols are frequently referred to in the art as "methyl fuel." The methyl fuel may be produced at a site closely adjacent the mined coal or it may be transported into the area in which is prepared the liquid-solid suspensoid or coal-alcohol slurry that is a feed stream for this process. In my hereinbefore referenced co-pending application Ser. No. 615,697, I have described the gasification of coal and the subsequent alcohol synthesis from the synthesis gas produced thereby. That descriptive matter is embodied herein by reference and need not be duplicated herein.

In an article, "Compounds From the Carbonization of Coal," Susan E. Woolridge, page 1357, et seq, of THE CHEMISTRY OF COAL UTILIZATION, Volume 1 and 2, 1945. H. H. Lowry, John Wiley & Sons, New York, N.Y. there is listed a Table XIX some 324 compounds identified from the carbonization of coal; and that table is incorporated herein by reference.

The coal will have one or more of the following materials depending upon its source, the materials being listed among the 324 constituents that have been found heretofore. The constituents that are recoverable from the coal include catechol, phenoals boiling between 200°and 300°C, carboxylic acids, bases, neutral oils, m-cresol, o-cresol, p-cresol, tar resins, the ketones including acetone and methylethyl ketone, acetic acid; propionic acid, n-buteric acid, valeric acid, saturated acids boiling to 300°C, pyridine, methylndole, unsaturated and saturated aldehydes, including acetaldehyde; methyl alcohol; acetonitrile; benzaldehyde; polyhydric phenols, including pyrogallol, hydroquinone and a methyl ether.

In the INTERNATIONAL CRITICAL TABLES OF NUMERICAL DATA, PHYSICS, CHEMISTRY AND TECHNOLOGY, National Research Council of the United States of America, compiled by C. J. West, McGraw Hill Book Company, New York, 1933, there are listed a variety of methyl alcohol admixture systems with other compounds. Many compounds are common in the respective Table XIX and the methyl alcohol systems discussed in the International Critical Tables. Among these are methanol in admixture with acetic acid, acetonitrile, aniline, benzaldehyde, benzoic acid, butane, butyric acid, the cresols, oxalic acid, propionic acid, pyridine, toluidine, and valeric acid. In addition, there are organic gases that are inexplicably liberated when the coal is worked in the presence of the alcohol. For example, methane and ethane gases, with a small proportion of propane, can be analyzed in the effluent organic gases.

The prior art workers have indicated that methanol and the lower molecular weight alcohols were very poor solvents to try to extract compounds from the coal. Yet, when the coal is worked in the presence of the alcohols, there is effected a peptization and dissolution and colloidal dispersion in the alcohols that is surprising and enables recovery of valuable chemical byproducts in an overflow stream.

Moreover, as indicated hereinbefore, the coals; particularly the lower quality coals; frequently have a substantial quantity of ash-forming minerals and the like therein that form a difficultly combustible fuel and add to the problems by producing large quantities of slag, ash or the like in the combustion chamber. Also, these low quality coals frequently have high percentages of sulfur or organic sulfur-containing compounds that cause pollutants when oxidized, or burned. The process of this invention rids the coal of these undesirable constituents.

In addition, in one embodiment of this invention, there is provided a coal that burns with a surprising ease and heat emission, since the coal particles are expanded, or puffed, to be more readily oxidized during combustion.

Referring to FIG. 1, a coal-alcohol admixture is formed preferably as delineated in my hereinbefore referenced application Ser. No. 615,697. In any event, the coal is in the presence of the alcohol and is comminuted in the presence of the alcohol for best results. If the coal-alcohol admixture 11 is not at an optimum concentration of about 40–50% solids, it may be diluted, as indicated by the block 13, with other alcohol 15. The resulting slurry of coal in alcohol is maintained, as by agitation 17, in a substantially uniform admixture until it can be flowed into a unit 19 for settling velocity separation. The unit 19 is preferably a nonturbulent cyclone separator.

In the separator 19, the particulate materials of higher settling velocities are separated and their concentration increased in the first underflow 21. The pressures of the separation will be dictated by the nature of the coal particulate material derived from the coal-alcohol slurry and the type of cyclone separators employed. In the separation, there is formed a first middling stream 23 that comprises primarily a first slurry of the coal particles. The separation effected by separator 19 also forms a first overflow 25 that comprises primarily the alcohol, a liquor of constituents dissolved from the comminuted coal in the alcohol and colloidal constituents suspended in the alcohol and the liquor.

The first underflow 21 is taken off at maximum density, ordinarily about 60–80% by weight solids. The first underflow 21 is again diluted back to the desired percent solids, as indicated by block 27. The desired concentration of solids will depend upon the type of separation to be employed subsequently. For example, for a velocity separation, it may be about 40–60% by weight of solids. The admixture of the solids and the alcohol formed in the dilution 27 is thereafter subjected to a settling velocity separation in the unit 29. Specifically, the solids are separated in the second underflow 31 as a second high density slurry that is analogously a moistened mass with very little excess liquid. The separation in unit 29 also produces a second overflow 33. The second overflow 33 has very low percent of solids in it and is returned elsewhere in the system, as to the first middling stream 23, for dilution.

As illustrated, the unit 29 is a unit such as a nonturbulent cyclone for separating by settling velocity separation. If desired, the separation can be effected by a centrifuge, such as a solid bowl or perferated bowl centrifuge.

While the entire underflow 31 can be discarded with very little loss, it is frequently advantageous to further separate it into the discardable sulfur and ash, and the alcohol accordingly, the separation is carried out as an evaporation in an evaporator 35 to produce the solids 37 and, by way of condensor 39, the alcohols 41. The solids 37, as indicated hereinbefore, are comprised primarily of sulfur and the ash-forming minerals and the like that have a high settling velocity. The alcohols are those discribed hereinbefore. The alcohols may be sent to storage or, as indicated by line 43, to effect the dilution in block 27; or combined with the first middling stream 23 via line 45.

The solids are dried by heating to a temperature T1 in the range of 140°–180° Farenheit; for example, about 160°F; and removing and recovering the alcohols by evaporation and condensation. The alcohols can also be recovered by pulling a vacuum on the slurry and using the heat energy in the materials to evaporate the alcohols. If this latter process is used, condensation is effective by compression of the vapors comprising the alcohols. Separated and dried solids will contain much of the ash forming materials and the sulfides of the original coal. While there may be commercial use for one or more of the materials, the principal objective is to reduce the sulfur and ash content of coal prior to combustion.

The solids 37 are discarded so as not to complicate the combustion of the low-sulfur, low-ash fuel that is subsequently formed in other streams.

The dilution indicated by block 27 may also be effected by alcohol from another source, as by block 47 which may take its alcohol from any one of a plurality of sources, such as the alcohol in line 45 that is normally sent to dilute the first middling stream 23.

The first middling stream 23 contains the bulk of the lower settling velocity particles formed by the coal.

The first middling stream 23 may be sent to a thickner to form a sheer thinning coal-alcohol slurry such as described in my above referenced application Ser. No. 615,697. Such a thickner may comprise a centrifuge or the like that separates out the sheer thinning coal-alcohol slurry as an underflow with the alcohol and alcohol soluble and dispersed materials as an overflow. As illustrated, however, the first middling stream 23 is diluted by the alcohols from an appropriate source; such as from lines 49, 51 or 45; and sent to a separation unit 53. The alcohol in line 51 will comprise the second overflow 33. The alcohol in 49 will comprise an underflow that will be described in more detail later hereinafter.

In the separation unit 53, the first middling stream 23 is separated into a third underflow 55, a second middling stream 57, and a third overflow 59.

The third underflow 55 comprises a second slurry of high density solids that is sent, as by dilution block 47, to be admixed with the first underflow 21 before separation of the solids from the alcohols.

The second middling stream comprises primarily a second slurry of the coal with only a minor amount of any high density solids and sulfur therein. The desired low-sulfur, low-ash fuel is formed from the second middling stream 57.

The first overflow 25 is separated in a separation unit 61 into a fourth overflow 63 and a fourth underflow 65. Separation units 61 may comprise any of the units appropriate to this separation, such as a centrifuge or the like. As illustrated it is a clarifier.

The fourth overflow 63 comprises primarily the alcohol, the liquor of the alcohol having dissolved therein the respective desired constituents, and the constituents that are peptized, or suspended in a collodial state. The fourth overflow 63 is refined, as illustrated by block 67, into the desired end products. As illustrated, the products 69 include alcohols, hydrocarbons, waxes, tars, paraffins, resins, and a variety of other valuable chemicals, such as delineated herebefore. The refining shown in block 67 may comprise any of the steps appropriate to the separation of a particular chemical, while elution through an adsorption column and the like may be appropriate for some of the more valuable chemicals, ordinarily, the refining steps will comprise distillation in which the various products are recovered at their respective boiling temperatures in a distillation column. For example, the normally gaseous constituents may be taken off as overhead from the column and recovered individually or employed as a fuel or the like, or as raw materials to another manufacturing process. Bottoms from such a distillation column may include more valuable constituents that are employed in perfumes, photographic industry, and other uses.

The second middling stream 57 may be sent to a thickner or the like to form the sheer thining coal-alcohol slurry, similarly as described with respect to the first middling stream 23. As illustrated, however, the second middling stream 57 is sent to a separation unit 71. The separation unit 71 effects separation of the second middling stream 57 into a fifth underflow 73, a third middling stream 75 and a fifth overflow 77.

The firth underflow is a third slurry of the high density, rapidly settling materials. The fifth underflow 73 is combined with other underflows, such as the third underflow 55 before being separated, as in separation unit 29.

The third middling stream comprises primarily the low-sulfur, low-ash coal slurried with the alcohol.

The third middling stream 75 may have its concentration adjusted, as by being sent to a thickener, to be formed into the sheer thinning coal-alcohol slurry such as described hereinbefore with respect to either the first middling stream 23 or the second middling stream 57. The adjusting of concentration is shown by the block 85 "Adjust Concentration." The shear thinning coal-alcohol slurry may be stored in suitable storage tank 79 for later being pumped into a pipeline; or it may be pumped directly into one or more pipelines 81. Ordinarily, a surge capacity is desirable so there will be both a storage tank 79 and the pipeline 81, with the associated pumping equipment (not shown).

Where storage tanks 79 are employed, it is preferable to enclose the storage tank and draw off the vaporous, organic effluent through line 83. The organic gases will comprise methane and can be used readily for fuel. On the other hand, as described hereinbefore, they may also be employed as inlet streams for petrochemical processes and the like or otherwise separated into their desirable constituents.

If desired, the third middling stream 75 can be separated directly into its alcohol or particulate coal constituents. This is indicated by the evaporation unit 87 for evaporating the alcohol and taking as a bottom, the particulate coal 89. It is noteworthy that the particulate coal 89 has had its sulfur and ash forming constituents substantially removed so that it will burn with very little pollution in the combustion gases. The gases from the evaporation unit 87 are condensed in condensor 91 to the desired end products or alcohols 93.

The alcohols 93 may be employed as a surge for the alcohols from the thickener unit 85. On the other hand, the alcohols may be flowed via line 95 to dilute the third middling stream 75 when it is too viscous to be pumped. If there is an excess of alcohol, it may be employed to dilute any of the other stages as shown by the respective dilution blocks in FIG. 1.

Figure 2:
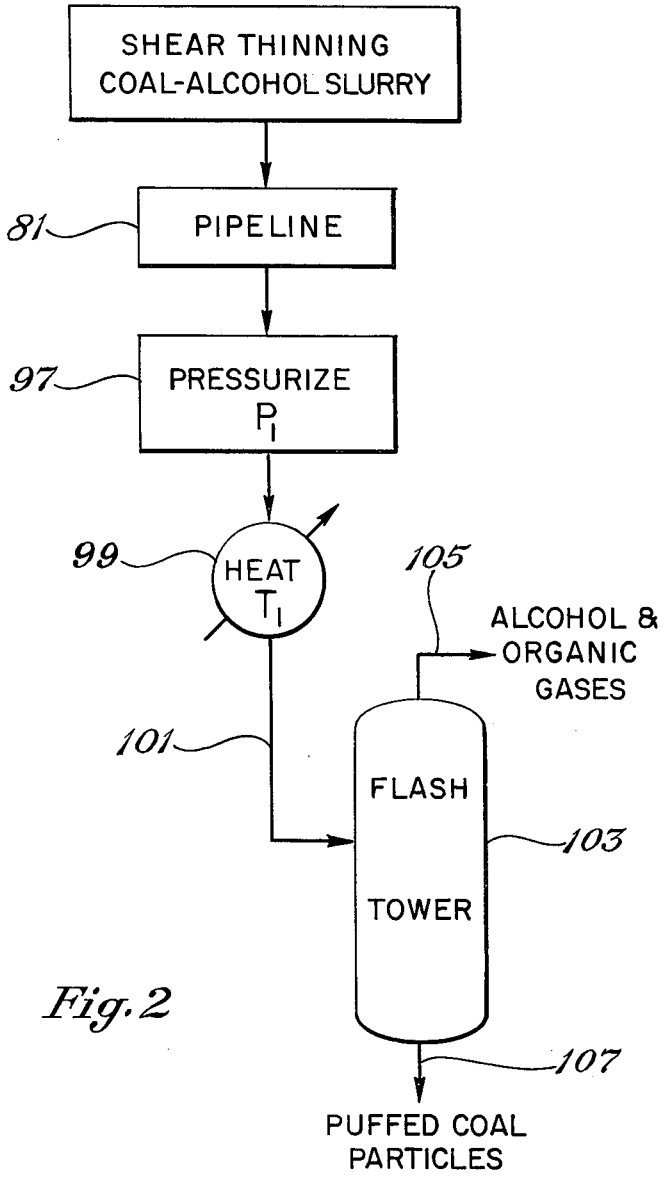
FIG. 2 is a partial flow diagram of a supplemental process used in accordance with another embodiment of this invention.

When the shear thinning coal-alcohol slurry is flowed through the pipeline 81, it may be treated at its destination by a process such as illustrated in FIG. 2. It is noteworthy, similarly, that the third middling streams 75 may be treated by the process of FIG. 2 whether or not it has been pumped through the pipeline. The process of FIG. 2 produces puffed coal particles that can be readily burned to produce an exceptionally hot flame.

Referring to FIG. 2, the shear thinning coal-alcohol slurry, as from pipeline 81, is pressurized to a suitable pressure P1, as shown by block 97. The shear thinning coal-alcohol slurry is also heated, as shown by the heat exchanger 99, to a temperature T1. Thereafter, the pressurized, heated shear thinning coal-alcohol slurry is sent via pipe 101 to a flash tower 103 where it is flashed to a lower pressure, such as atmospheric pressure. The heat content will effect a flashing of the organic gases and the alcohol, which are taken off via line 105. The alcohol and other condensible constituents are condensed via suitable heat exchanger (not shown) and the respective constituents are employed as described hereinbefore.

As a consequence of the flashing off of the alcohol and the organic gases, puffed coal particles are formed as a residue, or bottoms, in the flash tower. The puffed coal particles are conveyed by suitable conveyor from the bottom of the flash tower 103 to their respective storage piles. The puffed coal particles are highly susceptible to oxidation and can be readily burned in any process to give a hot flame with very low pollution emissions, since the sulfur and other pollutants have been removed. Moreover, the ash-forming minerals and the like have been removed from the coal particles before they are formed into the puffed coal particles.

From the foregoing, it can be seen that this invention achieves the objects delineated hereinbefore and forms a low-sulfur, low-ash coal as a fuel, while simultaneously recovering valuable chemical by-products, either directly dissolved in the alcohol or peptized into a colloidal dispersion in the alcohol for subsequent recovery.

Having thus described the invention, it will be understood that the description has been given by way of example and illustration and not by way of limitation, reference for the latter purpose being had to the appended claims.

What is claimed is:

1. A method of preparing low-sulfur, low-ash fuel from coal comprising the steps of:

a. comminuting the coal in the presence of an alcohol containing 1–4 carbon atoms, inclusive, to a size wherein a major part of said coal is of −100 mesh size;

b. forming an admixture of the resulting comminuted coal and said alcohol; said admixture containing at least 40 percent by weight of said coal;

c. separating said admixture into three streams, said streams being a first underflow stream comprising primarily a first slurry of high density solids, a first middling stream comprising primarily a first slurry of said coal particles, and a first overflow of stream comprising primarily said alcohol, a liquor of constituents dissolved from the comminuted coal in said alcohol and colloidal constituents suspended in said alcohol and said liquor;

d. separating said first underflow of said first slurry of high density solids into a second underflow comprising a second viscous slurry of sulfur and solids that would form ash residue if burned with the coal, and a second overflow comprising a dilute slurry of coal in said alcohol and the liquor of constituents dissolved from the comminuted coal in said alcohol;

e. separating said first middling stream into a third underflow comprising a second slurry of high density solids, a second middling stream comprising primarily a second slurry of said coal with only a minor amount of said high density solids and sulfur therein, and a third overflow comprising primarily said alcohol, a liquor comprising constituents dissolved in said alcohol and colloidal constituents suspended in said alcohol and said liquor;

f. separating said first overflow into a fourth underflow and a fourth overflow;

g. refining said fourth overflow into respective desired constituents and said alcohol; and h. forming a low-sulfur, low-ash fuel from said second middling stream.

2. The method of claim 1 wherein said coal is reduced in said alcohol in step a. until a major portion is of −200 mesh size.

3. The method of claim 1 wherein said separating in said step c. comprises a settling velocity separation.

4. The method of claim 1 wherein said second underflow of step d. is separated from said alcohol and discarded, said alcohol being removed.

5. The method of claim 4 wherein said alcohol is returned to the process for dilution of a slurry.

6. The method of claim 1 wherein said second overflow is being returned to said first middling stream for dilution thereof.

7. The method of claim 1 wherein said third overflow is added to said fourth overflow of step f. before said refining of step g.

8. The method of claim 1 wherein said third underflow is added to said first underflow and the combined stream is separated in accordance with step d.

9. The method of claim 1 wherein said second middling stream is separated into a fifth underflow, a third middling stream and a fifth overflow; said fifth underflow being combined with said third underflow and said first underflow; said third middling stream comprising a slurry of low-sulfur, low-ash coal; said fifth overflow being combined with said first and third overflows.

10. The method of claim 9 wherein said third middling stream is separated into a low-sulfur, low-ash coal for fuel, and said alcohol.

11. The method of claim 9 wherein said third middling stream is formed into a thixotropic dispersion of coal in alcohol pumped through a pipeline to a destination.

12. The method of claim 11 wherein the thixotropic dispersion is treated at said destination by a process comprising the following steps:

a. pressuring said dispersion to a predetermined pressure P1;

b. heating said thixotropic dispersion to a temperature within the range of 140°–180° F;

c. a flashing to atmospheric pressure to flash off and free said alcohol and organic gas including methane and to effect puffed coal particles that burn readily with a high efficiency and produce a hot flame with very little pollution; and d. collecting said alcohol and said organic gases and cooling and condensing the alcohol to separate said alcohol and said methane.

13. The method of claim 9 wherein said third middling stream is formed into a thixotropic dispersion of coal in alcohol and is treated by a process comprising the following steps:

a. pressuring said dispersion to predetermined pressure P1;

b. heating said thixotropic dispersion to a temperature within the range of 140°–180° F;

c. a flashing to atmospheric pressure to flash off and free said alcohol and organic gas including methane and to effect puffed coal particles that burn readily with a high efficiency and produce a hot flame with very little pollution; and d. collecting said alcohol and said organic gases and cooling and condensing the alcohol to separate said alcohol and said methane.

14. The method of claim 1 wherein said refining of said fourth overflow comprises distillation to form respective products comprising alcohols, hydrocarbons, waxes. tars, paraffins, and resins.

15. The method of claim 1 wherein said separating in step c. comprises a settling velocity separation; said second underflow of step d is separated from said alcohol and discarded, said alcohol being recovered and returned to dilute one of said first underflow and said first middling stream; said second overflow is returned to said first middling stream for dilution thereof; said third overflow is added to said fourth overflow of step f. before said refining of step g.; said third underflow is added to said first underflow and the resulting combined stream is separated in accordance to step d.; said second middling stream is separated into a fifth underflow, a third middling stream and a fifth overflow; said fifth underflow being combined with said third and first underflows; said third middling stream comprising a slurry of low-sulfur, low-ash coal; said fifth overflow being combined with said first and third overflows.

16. The method of claim 15 wherein said third middling stream is formed into a thixotropic dispersion of coal in alcohol and is stored in a contained storage; and organic gases including methane are collected and taken from the gas space above said dispersion.

17. The method of claim 1 wherein the comminution of said coal and said alcohol is effected in an enclosed apparatus and organic gases, including methane, are collected during said comminution of said step a.

* * * * *